US006718565B1

(12) United States Patent
Cruz

(10) Patent No.: US 6,718,565 B1
(45) Date of Patent: Apr. 13, 2004

(54) PORTABLE TOILET SHELTER

(76) Inventor: Alexis Cruz, 15 Maple Pl., Central Islip, NY (US) 11722

( * ) Notice: Subject to any disclaimer, the term of this patent is extended or adjusted under 35 U.S.C. 154(b) by 12 days.

(21) Appl. No.: 10/352,320

(22) Filed: Jan. 29, 2003

(51) Int. Cl.[7] ..... A47K 11/04
(52) U.S. Cl. ..... 4/476; 4/599; 135/117
(58) Field of Search ..... 4/476–478, 460, 4/599; 135/117, 118, 124

(56) References Cited

U.S. PATENT DOCUMENTS 1,538,311 A * 5/1925 Anticknap ..... 135/140
1,577,595 A * 3/1926 Smith ..... 4/460
1,652,581 A 12/1927 Roberts
3,547,136 A * 12/1970 Prinz ..... 135/156
4,685,484 A * 8/1987 Moneta ..... 135/87
5,379,466 A 1/1995 Davies
5,671,487 A 9/1997 Chen
5,790,992 A * 8/1998 Ray ..... 4/599
D398,062 S 9/1998 Lockhart
5,918,615 A * 7/1999 Stuck, Sr. ..... 135/135
5,920,927 A 7/1999 Thomas
5,937,452 A * 8/1999 Brewer ..... 4/460
5,970,536 A * 10/1999 Suarez ..... 4/599
5,974,597 A 11/1999 Conwell

* cited by examiner

*Primary Examiner*—Charles E. Phillips

(57) ABSTRACT

A portable toilet shelter for providing complete privacy for a user having to use an outdoor toilet. The portable toilet shelter includes a side wall structure including a base sheet of material having longitudinal side edges and also having top and bottom edges and further having first sleeve portions being disposed in the base sheet of material and being adapted to be erected about a toilet; and also includes a side wall structure support assembly for supporting the side wall structure upon a ground; and further includes a roof assembly including a roof member, and also including a frame being attached to the roof member and being removably connected to the side wall structure support assembly; and also includes a fastening assembly including a fastening member being attached to the base sheet of material and roof member for closing the base sheet of material and the roof member about the toilet.

8 Claims, 3 Drawing Sheets

PORTABLE TOILET SHELTER

BACKGROUND OF THE INVENTION

1. Field of the Invention

The present invention relates to toilet shelters and more particularly pertains to a new portable toilet shelter for providing complete privacy for a user having to use an outdoor toilet.

2. Description of the Prior Art

The use of toilet shelters is known in the prior art. More specifically, toilet shelters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,974,597; U.S. Pat. No. 1,652,581; U.S. Pat. No. 5,671,487; U.S. Pat. No. 5,379,466; U.S. Pat. No. 5,920,927; and U.S. Pat. No. Des. 398,062.

While these devices fulfill their respective, particular objectives and requirements, the aforementioned patents do not disclose a new portable toilet shelter. The prior art includes tents being erected about the toilets.

SUMMARY OF THE INVENTION

The general purpose of the present invention, which will be described subsequently in greater detail, is to provide a new portable toilet shelter which has many of the advantages of the toilet shelters mentioned heretofore and many novel features that result in a new portable toilet shelter which is not anticipated, rendered obvious, suggested, or even implied by any of the prior art toilet shelters, either alone or in any combination thereof. The present invention includes a side wall structure including a base sheet of material having longitudinal side edges and also having top and bottom edges and further having first sleeve portions being disposed in the base sheet of material and being adapted to be erected about a toilet; and also includes a side wall structure support assembly for supporting the side wall structure upon a ground; and further includes a roof assembly including a roof member, and also including a frame being attached to the roof member and being removably connected to the side wall structure support assembly; and also includes a fastening assembly including a fastening member being attached to the base sheet of material and roof member for closing the base sheet of material and the roof member about the toilet. None of the prior art includes the combination of the elements of the present invention.

There has thus been outlined, rather broadly, the more important features of the portable toilet shelter in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable toilet shelter which has many of the advantages of the toilet shelters mentioned heretofore and many novel features that result in a new portable toilet shelter which is not anticipated, rendered obvious, suggested, or even implied by any of the prior art toilet shelters, either alone or in any combination thereof.

Still another object of the present invention is to provide a new portable toilet shelter for providing complete privacy for a user having to use an outdoor toilet.

Still yet another object of the present invention is to provide a new portable toilet shelter that is easy and convenient to set up and use.

Even still another object of the present invention is to provide a new portable toilet shelter that allows for the escape of odors from the toilet and can be fastened for complete closure about the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
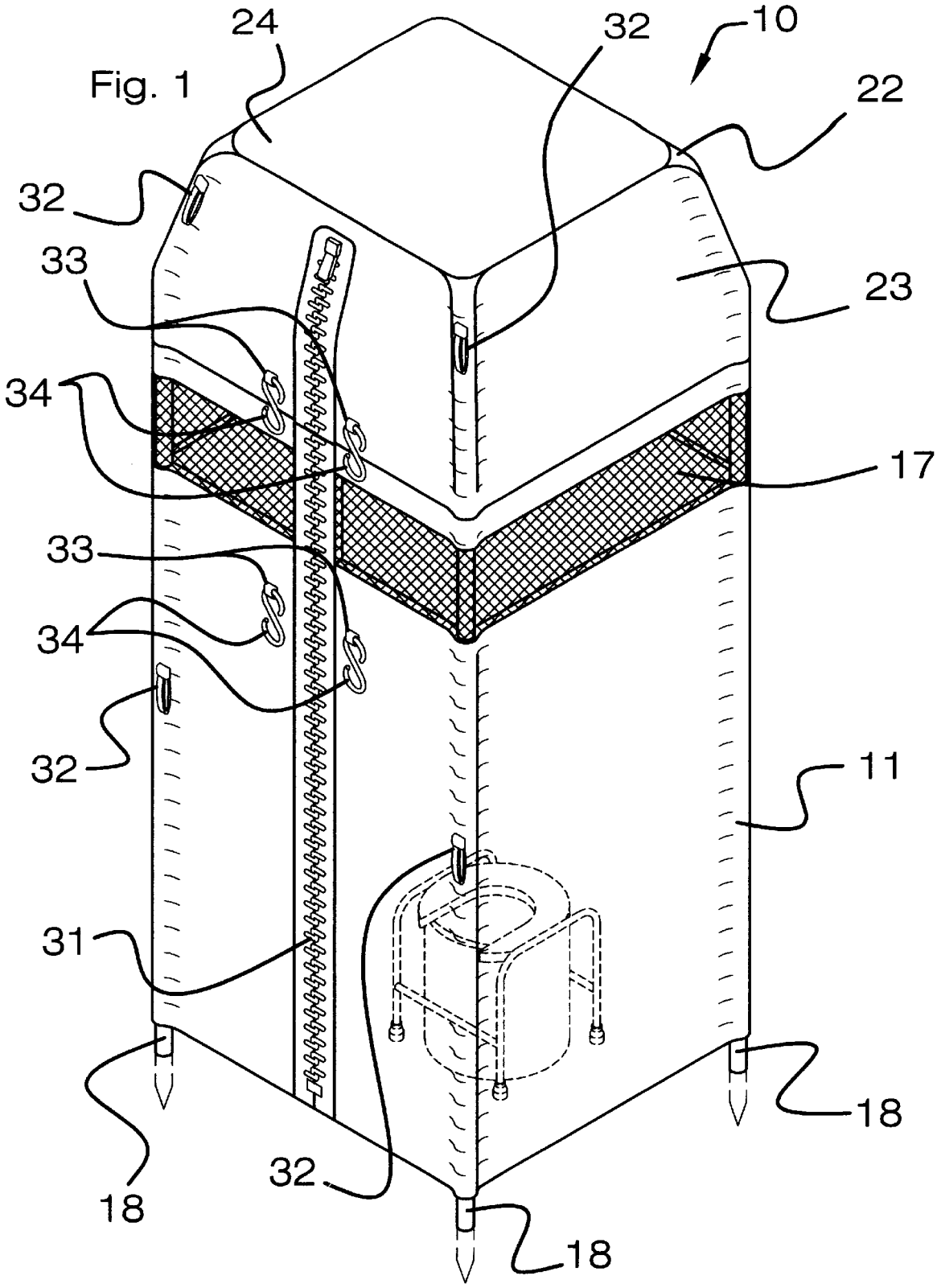
FIG. 1 is a perspective view of a new portable toilet shelter according to the present invention.
Figure 2:
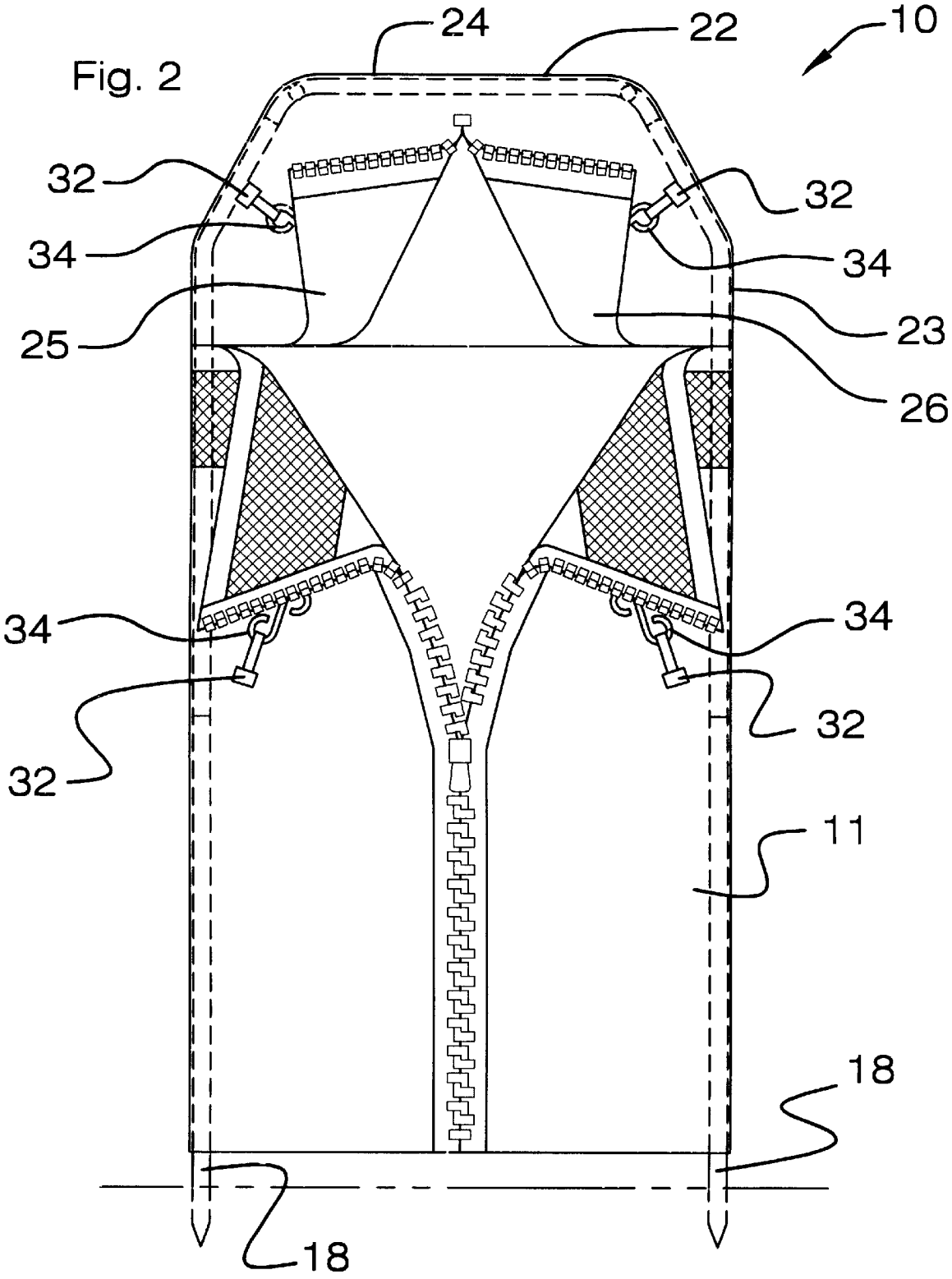
FIG. 2 is a side elevational view of the present invention.
Figure 3:
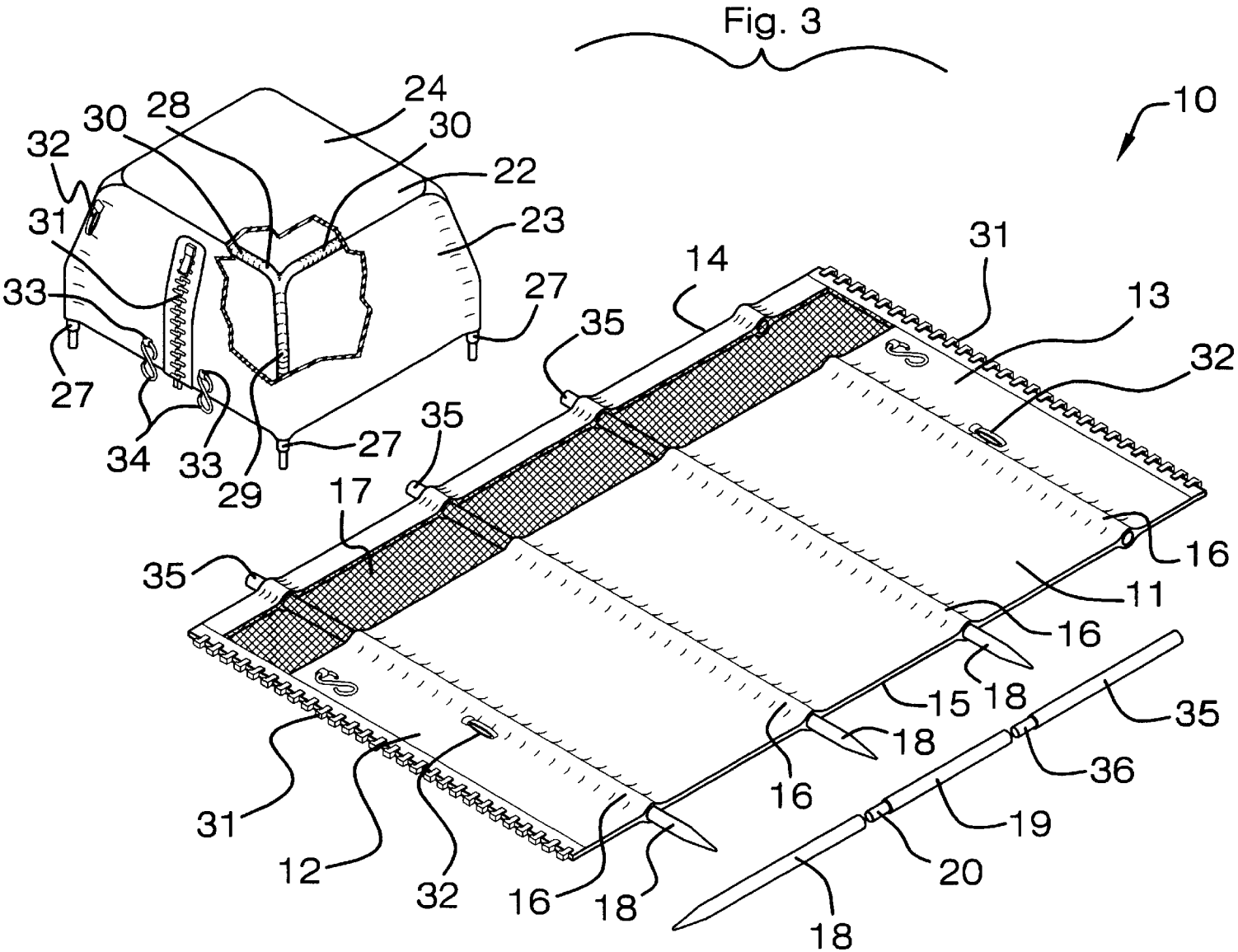
FIG. 3 is an exploded perspective view of the present invention.

With reference now to the drawings, and in particular to FIGS. 1 through 3 thereof, a new portable toilet shelter embodying the principles and concepts of the present invention and generally designated by the reference numeral 10 will be described.

As best illustrated in FIGS. 1 through 3, the portable toilet shelter 10 generally comprises a side wall structure including a base sheet of material 11 having longitudinal side edges 12,13 and also having top and bottom edges 14,15 and further having first sleeve portions 16 being conventionally disposed in the base sheet of material 11 and being adapted to be erected about a toilet. The side wall structure further includes a mesh material 17 being conventionally disposed in the base sheet of material 11 near the top edge 14 thereof and extending from one longitudinal side edge 12 to the other longitudinal side edge 13 of the base sheet of material 11 for providing venting for the toilet.

A side wall structure support assembly for supporting the side wall structure upon a ground includes a plurality of base stakes 18 being removably and conventionally disposed in the first sleeve portions and having tapered bottom ends for penetrating into the ground, and also includes a plurality of first extension poles 19 having annular recessed bottom end portions 20 and being removably and conventionally attached to top ends of the base stakes 18 and being removably and conventionally disposed in the first sleeve portions 16, and further includes a plurality of second extension poles 35 having annular recessed bottom end portions 36 and being removably and conventionally attached to top ends of the first extension poles 19 and being removably and conventionally disposed in the first sleeve portions 16.

A roof assembly includes a roof member 22, and also includes a frame 28 being conventionally attached to the roof member 22 and being removably and conventionally connected to the side wall structure support assembly. The roof member 22 includes one or more side sheets of material 23 forming side walls of the roof member 22, and also includes a top sheet of material 24 being conventionally attached to one or more side sheets of material 23 and forming a top wall of the roof member 22, and further includes second sleeve portions 27 being spacedly and conventionally disposed in the one or more side sheets of material 23. The one side sheets of material 23 has longitudinal side edges 25,26 extending from a bottom edge to a top edge thereof. The frame includes elongate corner members 29 being conventionally disposed in the second sleeve portions 27 of the roof member 22 and extending beyond the bottom edges of the one or more side sheets of material 23, and also includes elongate cross members 30 conventionally interconnecting the elongate corner members 29 and forming top edges of the roof member 22.

A fastening assembly includes a fastening member 31 being conventionally attached to the base sheet of material 11 and the roof member 22 for closing the base sheet of material 11 and the roof member 22 about the toilet. The fastening member 31 is a zipper being conventionally attached along the longitudinal side edges 12,13 of the base sheet of material 11 and the one or more side sheets of material 23. The zipper includes strips of material having teeth being conventionally disposed along longitudinal edges thereof and also having a teeth connector for fastening the teeth together. The fastening assembly also includes a plurality of loop members 32 being conventionally attached to outer sides of the base sheet of material 11 and the one or more side sheets of material 23, and further includes eyelets 33 being conventionally attached to outer sides of the base sheet of material 11 and the one or more side sheets of material 23 near the longitudinal side edges 12,13,25,26 of the base sheet of material 11 and the one or more side sheets of material 23, and also includes S-shaped hook members 34 being conventionally attached to the eyelets 33 and being connectable to the loop members 32 to hold portions of the base sheet of material 11 and the one or more side sheets of material 23 back to allow a user to enter and exit the portable toilet shelter.

In use, the user unzips the zipper and enters the portable toilet shelter 10. If the user chooses, the user can hooks portions of the base sheet of material 11 and the one or more side sheets of material 23 back upon themselves using the S-shaped hook members 34 and the loop members 32. Once finished, the portable toilet shelter 10 can be taken down and apart by removing the base stakes 18 from the ground and removing the base stakes 18 and the first and second extension poles 19,35 from the first sleeve portion 16, and can also remove the frame 28 from the second extension poles 35.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable toilet shelter. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable toilet shelter comprising:

a side wall structure including a base sheet of material having longitudinal side edges and also having top and bottom edges and further having first sleeve portions being disposed in said base sheet of material and being adapted to be erected about a toilet;

a side wall structure support assembly for supporting said side wall structure upon a ground;

a roof assembly including a roof member, and also including a frame being attached to said roof member and being removably connected to said side wall structure support assembly; and a fastening assembly including a fastening member being attached to said base sheet of material and said roof member for closing said base sheet of material and said roof member about the toilet.

2. A portable toilet shelter as described in claim 1, wherein said side wall structure further includes a mesh material being disposed in said base sheet of material near said top edge thereof and extending from one of said longitudinal side edges to the other of said longitudinal sides of said base sheet of material for providing venting for the toilet.

3. A portable toilet shelter as described in claim 2, wherein said side wall structure support assembly includes a plurality of base stakes being removably disposed in said first sleeve portions and having tapered bottom ends for penetrating into the ground, and also includes a plurality of first extension poles having annular recessed bottom end portions and being removably attached to top ends of said base stakes and being removably disposed in said first sleeve portions, and further includes a plurality of second extension poles having annular recessed bottom end portions and being removably attached to top ends of said first extension poles and being removably disposed in said first sleeve portions.

4. A portable toilet shelter as described in claim 3, wherein said roof member includes one or more side sheets of material forming side walls of said roof member, and also includes a top sheet of material being attached to said one or more side sheets of material and forming a top wall of said roof member, and further includes second sleeve portions being spacedly disposed in said one or more side sheets of material.

5. A portable toilet shelter as described in claim 4, wherein said one or more side sheets of material has longitudinal side edges extending from a bottom edge to a top edge thereof.

6. A portable toilet shelter as described in claim 5, wherein said frame includes elongate corner members being disposed in said second sleeve portions of said roof member and extending beyond said bottom edges of said one or more side sheets of material, and also includes elongate cross members interconnecting said elongate corner members and forming top edges of said roof member.

7. A portable toilet shelter as described in claim 6, wherein said fastening member is a zipper being attached along said longitudinal side edges of said base sheet of material and said one or more side sheets of material, said zipper includes strips of material having teeth being disposed along longitudinal edges thereof and also having a teeth connector for fastening said teeth together.

8. A portable toilet shelter as described in claim 7, wherein said fastening assembly also includes a plurality of loop members being attached to outer sides of said base sheet of material and said one or more side sheets of material, and further includes eyelets being attached to outer sides of said base sheet of material and said one or more side sheets of material near said longitudinal side edges of said base sheet of material and said one or more side sheets of material, and also includes S-shaped hook members being attached to said eyelets and being connectable to said loop members to hold portions of said base sheet of material and said one or more side sheets of material back to allow a user to enter and exit said portable toilet shelter.

* * * * *